United States Patent [19]

Marchal

[11] Patent Number: 4,886,708

[45] Date of Patent: Dec. 12, 1989

[54] PROCESS FOR THE MANUFACTURING OF SYNTHETIC COVERINGS HAVING IMPROVED RESISTANCE TO SOILING, AND SYNTHETIC COVERING OBTAINED THEREBY

[75] Inventor: Daniel Marchal, Burden, Luxembourg

[73] Assignee: Eurofloor S.A., Luxembourg

[21] Appl. No.: 96,376

[22] Filed: Sep. 14, 1987

[30] Foreign Application Priority Data

Oct. 3, 1986 [LU] Luxembourg ..... 86620

[51] Int. Cl.[4] ..... B05D 3/02; B32B 9/04

[52] U.S. Cl. ..... 428/447; 427/387; 427/393.4; 524/506; 525/104

[58] Field of Search ..... 427/387, 389.9, 393.4; 525/105; 524/506; 428/447

[56] References Cited

U.S. PATENT DOCUMENTS 3,814,706 6/1974 Simoncaw et al. ..... 525/104 X 4,258,085 3/1981 Kauffman et al. ..... 427/244

4,278,713 7/1981 Burba et al. ..... 427/389.9 X

FOREIGN PATENT DOCUMENTS 955224 1/1957 Fed. Rep. of Germany .

1471359 3/1967 France .

1248583 10/1971 United Kingdom .

*Primary Examiner*—Michael Lusignan

*Attorney, Agent, or Firm*—Fishman, Dionne & Cantor

[57] ABSTRACT

A process for the manufacturing of plastisol based synthetic coverings (e.g. floor or wall coverings) having improved resistance to soiling; and the product produced from the process is presented. The synthetic covering utilizes a wear layer formed from a mixture comprising at least one silicone polymer and a cross-linking agent. Preferably, this mixture also includes a catalyst. The mixture is deposited onto a conventional support as a wear layer. The silicone polymer is then cross-linked and the wear layer undergoes pre-gelling and gelling.

17 Claims, No Drawings

PROCESS FOR THE MANUFACTURING OF SYNTHETIC COVERINGS HAVING IMPROVED RESISTANCE TO SOILING, AND SYNTHETIC COVERING OBTAINED THEREBY

BACKGROUND OF THE INVENTION

This invention relates to a process for the manufacture of plastisol based synthetic coverings (e.g., floor or wall coverings) having improved resistance to soiling. This invention also relates to a floor or wall covering obtained by means of this process.

One of the well known difficulties encountered in the use of plastisol based synthetic coverings, particularly plastisol based floor coverings, comprises soiling, particularly soiling by shoe heels. It is known that soiling can be reduced by increasing the slipperiness of the covering, thus avoiding heating caused by the friction of a heel on the covering.

An increase of slipperiness may be achieved by adding to the surface coating plastisol a silicone polymer, preferably a silicone polymer incompatible with the surface plastisol. This incompatibility is for the purpose of promoting migration of the silicone to the surface. However, the slipperiness effect quickly disappears during successive washings and/or cleanings of the covering by means of the washing and/or cleaning agents normally used.

SUMMARY OF THE INVENTION

The above-discussed and other problems and deficiencies of the prior art are overcome or alleviated by the process for the manufacture of plastisol based floor or wall coverings of the present invention comprising a wear layer having improved resistance to soiling, particularly to soiling by shoe heels. The present invention also provides a synthetic covering having a plastisol based wear layer of a novel type. This novel wear layer is formed from a mixture comprising at least one silicone polymer and a cross-linking agent. Preferably, this mixture also includes a catalyst. The mixture is deposited onto a conventional support as a wear layer. The silicone polymer is then cross-linked and the wear layer undergoes pre-gelling and gelling.

An important feature of the synthetic coverings of the present invention is the provision of a plastisol based wear layer possessing improved resistance to soiling, particularly to soiling due to shoe heels, even after repeated washings and/or cleanings.

The above-discussed and other features and advantages of the present invention will be appreciated and understood by those skilled in the art from the following detailed description.

DESCRIPTION OF THE PREFERRED EMBODIMENT

In accordance with a first embodiment of the present invention, a process for the manufacture of plastisol based floor or wall coverings having improved resistance to soiling comprises the formation of a plastisol mixture containing a silicone polymer, a cross-linking agent, and optionally a catalyst. Next, this mixture is deposited on a decorative support to serve as a wear layer. The wear layer is then pre-gelled and gelled. The silicone polymer is preferably incompatible with the wear layer plastisol.

The cross-linking of the silicone polymer is preferably effected at the time as the gelling of the wear layer plastisol. Migration of the silicone polymer to the surface is permitted by control of the cross-linking of the polymer, which is preferably effected at the same time as the gelling of the plastisol, this being achieved through the appropriate choice of the catalyst and cross-linking agent pair; and by suitable proportioning of these two components.

In a particularly preferred emboiment of the present invention, the silicone polymer comprises a silicone gum containing —OH functional groups. The cross-linking agent may consist of a fluid based on silicone containing reactive —H groups. However, the cross-linking agent may also consist of an optionally blocked type isocyanate. When a blocked type isocyanate is used, the system and the liberation of —NCO groups permitting the cross-linking of the silicone polymer containing —OH groups is initiated at a relatively high temperature (which, however, is lower than the maximum working temperature, for example 130° C.). The surface migration of the silicone polymers is thus promoted. The utilization of a system comprising a silicone polymer and a blocked type isocyanate makes it possible to prepare a stable system which can be stored for a long time.

It is advantageous, in order to obtain a particularly preferable result, to mix from 0.1 to 10% of silicone polymer containing OH groups and permitting cross-linking in the wear layer plastisol. The ratio of silicone to cross-linking agent is between 10:10 and 10:0.1. Depending on the type of catalyst used (for example a tin or barium-zinc catalyst and for example a PVC stabilizer), the ratio of catalyst to silicone may be between 0.1 and 0.001.

According to another feature of the present invention, it is also contemplated that the floor or wall covering may include a decorative support obtained by processes known per se, covered with a wear layer based on a plastisol containing a cross-linked silicone polymer in accordance with the process of the present invention.

In order to improve still further the effect obtained, micronized polyethylene wax may be added to the plastisol mixture intended to form the wear layer.

It is also preferable for the cross-linked silicone polymer to have a high density at the surface then in the heart of the wear layer.

The following are non-limiting examples describing the present invention:

EXAMPLE 1

The cross-linking of the silicone was studied under the following conditions:

| | | | | | | | | | |
|---|---|---|---|---|---|---|---|---|---|
| SILICONE | 10 | 10 | 10 | 10 | 10 | 10 | 10 | 10 | 10 |
| CROSS-LINKING AGENT | 7 | 7 | 3 | 3 | 3 | 3 | 3 | 3 | 3 |
| Sn CATALYST (DOW CORNING XY 176) | 1 | — | — | 1 | 0.5 | 0.1 | 0.5 | 0.01 | — |
| Ba—Zn CATALYST | — | — | — | — | — | — | — | — | 1 |

The silicone polymer used in a Dow Corning gum of the type Q 2 32 38 (trade name) containing —OH functional groups. The cross-linking agent is Dow Corning 1107 Fluid, which contains silicone containing —H groups.

The degree of cross-linking corresponding to temperatures of 150° C. and 190° C. were observed as follows:

| | | | | | | | | | | |
|---|---|---|---|---|---|---|---|---|---|---|
| 150° | 1' | 3 | 0 | 0 | 3 | 2 | 1 | 1 | 1 | 0 |
| | 2' | 3 | 0 | 0 | 3 | 3 | 2 | 1 | 1 | 1 |
| | 3' | 3 | 0 | 0 | 3 | 3 | 3 | 2 | 1 | 1 |
| 190° | 1' | 3 | 0 | 0 | 3 | 3 | 3 | 2 | 1 | 1 |
| | 2' | 3 | 0 | 0 | 3 | 3 | 3 | 3 | 2 | 2 |
| | 3' | 3 | 0 | 0 | 3 | 3 | 3 | 3 | 2 | 2 |

0 = zero cross-linking
1 = start of cross-linking
2 = middle of cross-linking
3 = complete cross-linking Resistance to soiling by shoe heels with respect to washing and/or cleaning cycles, and also the unexpected effect of cross-linking are shown in the following table for various compositions used.

| | T | 1 | 2 | 3 | 4 |
|---|---|---|---|---|---|
| PVC PLASTISOL | 100 | 100 | 100 | 100 | 100 |
| SILICONE | — | 3.14 | 1.85 | 2.41 | 2.41 |
| CROSS-LINKING AGENT | — | — | 1.29 | 0.72 | 0.72 |
| CATALYST (Sn) | — | — | — | 0.013 | 0.002 |
| IMMEDIATE SOILING | 3 | 0 | 0 | 0 | 0 |
| SOILING AFTER 100 CLEANING CYCLES (AJAX ®) | 5 | 3 | 2 | 2 | 1 |
| NUMBER OF CYCLES NEEDED TO ELIMINATE SOILING | 8 | 5 | 3 | 3 | 1 |

0 = no soiling
5 - heavy soiling

Independent of the cleaning, a lack of resistance to soiling was found for the control (T).

The utilization of a non-cross-linked silicon gum (1) according to a conventional process avoids immediate soiling, but does not prevent relatively considerable soiling after a few cleaning cycles. This is due to the fact that the silicone is not cross-linked and is contained in an emulsifiable system washable with cleaning water.

Tests (2), (3) and (4) show that through the use of a cross-linking agent for the silicone polymer, the resistance to soiling is substantially improved, even after 100 washing cycles.

Particularly advantageous results are obtained in Test No. 4 because of the use of a catalytic system which adapts the cross-linking so as to permit the migration to the surface of a silicone polymer which is incompatible with the plastisol in which it is mixed.

EXAMPLE 2

In a second example, the cross-linking agent used was a polyaliphatic polyisocyanate in a solution containing about 8% of free isocyanate. Through the use of this cross-linking agent, the storability of the resulting product is improved and the migration of the silicones to the surface is promoted (in view of the fact that the liberation of the blocked —NCO groups starts only at a temperature on the order of 130° C.).

| The composition used is: | |
|---|---|
| PVC plastisol | 100 |
| Silicone polymer | 1.25 |

-continued

| The composition used is: | |
|---|---|
| (Q 2 32 38 Dow Corning) | |
| Micronized polyethylene wax | 2 |
| Cross-Linking agent: HULS | 0.35 |
| IPDI B 1370 (commercial name) | |
| Tin catalyst | 0.001 |
| (Dibutyltin dilaurate). | |

The above plastisol mixture can be stored for a long time without undergoing cross-linking of the silicone system which is a particularly advantageous feature.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Process for the manufacture of plastisol based synthetic coverings comprising the steps of:

forming a plastisol mixture containing at least one crosslinkable silicone polymer and a silicone polymer cross-linking agent;

depositing said plastisol mixture on a support to define a wear layer;

cross-linking said silicone polymer;

pre-gelling said wear layer; and gelling said wear layer.

2. Process according to claim 1 including the step of:

selecting a silicone polymer which is incompatible with the plastisol of said wear layer.

3. Process according to claim 1 including the step of:

adding a catalyst to said plastisol mixture.

4. Process according to claim 3 including the step of:

selecting the composition and proportions of said silicone polymer, cross-linking agent and catalyst so as to permit the cross-linking of the silicone polymer at the same time as the pre-gelling or gelling of said plastisol wear layer.

5. Process according to claim 1 wherein:

said pre-gelling and gelling steps for said wear layer are effected simultaneously.

6. Process according to claim 1 wherein:

said silicone polymer comprises a silicone gum containing —OH groups.

7. Process according to claim 1 wherein:

said cross-linking agent comprises a fluid based on a silicone containing reactive —H groups.

8. Process according to claim 1 wherein:

said cross-linking agent comprises a blocked isocyanate.

9. Process according to claim 1 wherein:

between about 0.1 to about 10% of said silicone polymer is mixed in said plastisol of said wear layer.

10. Process according to claim 1 including the step of:

adding micronized wax to said plastisol of said wear layer.

11. Process according to claim 3 wherein:

said catalyst is a tin or barium-zinc catalyst.

12. A plastisol based synthetic covering produced from the process of claim 1.

13. Synthetic covering comprising:

a support layer; and a plastisol based wear layer covering said support layer, said plastisol based wear layer including at least one cross-linked silicone polymer therein.

14. Synthetic covering according to claim 13 wherein:

said cross-linked silicone polymer has a higher density on the surface of said wear layer than in the interior of said wear layer.

15. Synthetic covering according to claim 13 wherein:

said silicone polymer comprises a silicone gum having functional —OH groups.

16. Synthetic covering according to claim 13 wherein:

said plastisol based wear layer includes micronized wax.

17. Synthetic covering of claim 16 wherein:

said micronized wax comprises micronized polyethylene or polytetrafluoroethylene wax.

* * * * *